US009430982B2

(12) United States Patent
Kim et al.

(10) Patent No.: US 9,430,982 B2
(45) Date of Patent: Aug. 30, 2016

(54) DISPLAY APPARATUS

(71) Applicant: Samsung Display Co., Ltd., Yongin, Gyeonggi-do (KR)

(72) Inventors: Yun-Tae Kim, Seoul (KR); Keunoh Kang, Uijeongbu-si (KR); Jae-Hyeon Kwon, Asan-si (KR); Minji Kim, Busan (KR); Chaewoo Chung, Cheonan-si (KR); Jung-Mok Han, Cheonan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 91 days.

(21) Appl. No.: 14/065,256

(22) Filed: Oct. 28, 2013

(65) Prior Publication Data

US 2014/0340381 A1 Nov. 20, 2014

(30) Foreign Application Priority Data

May 14, 2013 (KR) ..... 10-2013-0054494

(51) Int. Cl.
*G09G 5/00* (2006.01)
*G09G 3/36* (2006.01)

(52) U.S. Cl.
CPC ..... *G09G 3/3677* (2013.01); *G09G 3/3655* (2013.01); *G09G 2310/06* (2013.01); *G09G 2320/0219* (2013.01)

(58) Field of Classification Search
CPC ..... G09G 3/3677; G09G 3/3655; G09G 2310/06; G09G 2320/0219
USPC ..... 345/204
See application file for complete search history.

(56) References Cited

U.S. PATENT DOCUMENTS

| | | | | |
|---|---|---|---|---|
| 7,821,512 | B2 | 10/2010 | Yi | |
| 8,054,272 | B2 | 11/2011 | Lee et al. | |
| 8,253,668 | B2 | 8/2012 | Kim et al. | |
| 2007/0024560 | A1* | 2/2007 | Kim et al. | 345/94 |
| 2007/0164963 | A1* | 7/2007 | Kim et al. | 345/98 |
| 2008/0170064 | A1* | 7/2008 | Lee | G09G 3/3677 345/214 |
| 2012/0242641 | A1 | 9/2012 | Lee et al. | |
| 2012/0262440 | A1* | 10/2012 | Zhao | 345/212 |
| 2013/0215160 | A1* | 8/2013 | Pyun | G09G 3/3655 345/691 |

FOREIGN PATENT DOCUMENTS

| | | | |
|---|---|---|---|
| KR | 10-2006-0118775 | A | 11/2006 |
| KR | 10-2007-0068098 | A | 6/2007 |
| KR | 10-2007-0082232 | A | 8/2007 |
| KR | 10-2008-0002237 | A | 8/2007 |
| KR | 10-2010-0063170 | A | 6/2010 |
| KR | 10-1106346 | B1 | 1/2012 |
| KR | 10-2012-0056650 | A | 6/2012 |

* cited by examiner

*Primary Examiner* — Jonathan Boyd
(74) *Attorney, Agent, or Firm* — Knobbe, Martens, Olson & Bear, LLC

(57) ABSTRACT

A display apparatus is disclosed. In one aspect, the apparatus includes a display panel including pixels connected to gate lines and data lines, a gate driver driving the gate lines, a data driver driving the data lines, and a control circuit controlling the gate driver and the data driver to display an image on the display panel. The control circuit applies a common voltage to the display panel. The control circuit compares the common voltage applied to the display panel and a feedback common voltage fedback from the display panel and applies a gate-on voltage having a voltage level corresponding to the compared result to the gate driver.

20 Claims, 10 Drawing Sheets

DISPLAY APPARATUS

CROSS-REFERENCE TO RELATED APPLICATION

This U.S. non-provisional patent application claims priority under 35 U.S.C. §119 of Korean Patent Application No. 10-2013-0054494, filed on May 14, 2013, the contents of which are hereby incorporated by reference.

BACKGROUND

1. Field

The present disclosure generally relates to a display apparatus, more particularly, to a display apparatus having an improved display quality.

2. Description of the Related Technology

In general, a display apparatus includes a display panel and gate drivers to drive the display panel. The display panel typically includes a plurality of gate lines, a plurality of data lines, and a plurality of pixels. Each pixel generally includes a switching transistor, a liquid crystal capacitor, and a storage capacitor. The data driver applies a data driving signal to the data lines and the gate driver applies a gate driving signal to the gate lines.

The display apparatus applies a gate on voltage to a gate electrode of the switching transistor connected to the gate line connected to the pixel, in which the image is displayed, and applies a data voltage, which corresponds to the image, to a source electrode of the switching transistor, thereby displaying a desired image. The data voltage is charged in a liquid crystal capacitor and a storage capacitor while the switching transistor is turned on. The display generally maintains the voltage for a predetermined time after the switching transistor is turned off. A gray-scale voltage applied to the liquid crystal capacitor and the storage capacitor can be distorted due to a parasitic capacitance that exists between gate and drain electrodes of the switching transistor. That is, there can be a difference between the gray-scale voltage output from the data driver and the gray-scale voltage applied to the liquid crystal capacitor and the storage capacitor. The distorted voltage is often called a kickback voltage. As the kickback voltage and a difference between kickback voltages of the switching transistors become large, a display quality of the image displayed in the display panel can deteriorate.

SUMMARY OF CERTAIN INVENTIVE ASPECTS

One inventive aspect is a display apparatus capable of improving a display quality of an image displayed on a display panel thereof.

Another aspect is a display apparatus including a display panel that includes a plurality of pixels connected to a plurality gate lines and a plurality of data lines, a gate driver that drives the gate lines, a data driver that drives the data lines, and a control circuit that controls the gate driver and the data driver to display an image on the display panel and applies a common voltage to the display panel. The control circuit compares the common voltage applied to the display panel and a feedback common voltage fedback from the display panel and applies a gate-on voltage having a voltage level corresponding to the compared result to the gate driver.

The control circuit applies the gate-on voltage having a kickback slice to the gate driver when the common voltage applied to the display panel has substantially the same voltage level as the feedback common voltage fedback from the display panel.

The control circuit can apply the gate-on voltage having no kickback slice to the gate driver when the common voltage applied to the display panel has a voltage level different from the feedback common voltage fedback from the display panel.

The control circuit can include a timing controller that controls the data driver and the gate driver in response to an image signal and a control signal from an external source and outputs a kickback signal in response to a kickback control signal, a voltage generator that outputs the gate-on voltage in response to the kickback signal, a common voltage generator that generates the common voltage, and a glitch detector that compares the common voltage generated by the common voltage generator with the feedback common voltage fedback from the display panel to output the kickback control signal based on the compared result.

The kickback signal can have a pulse width corresponding to a width of the kickback slice included in the gate-on voltage.

The control circuit can include a timing controller that controls the data driver and the gate driver in response to an image signal and a control signal from an external source, a common voltage generator that generates the common voltage, a voltage generator that generates a first gate-on voltage and a second gate-on voltage, and a glitch detector that compares the common voltage generated by the common voltage generator with the feedback common voltage fedback from the display panel to apply the first gate-on voltage or the second gate-on voltage to the gate driver based on the compared result.

The second gate-on voltage can comprise a kickback slice.

The glitch detector can apply the second gate-on voltage to the gate driver when the common voltage generated by the common voltage generator has substantially a same voltage level as the feedback common voltage fedback from the display panel.

The glitch detector can apply the first gate-on voltage to the gate driver when the common voltage generated by the common voltage generator has a voltage level different from the feedback common voltage fedback from the display panel.

The glitch detector can include a multiplexer that outputs one of the first gate-on voltage and the second gate-on voltage in response to the common voltage and the feedback common voltage.

The control circuit can include a timing controller that controls the data driver and the gate driver in response to an image signal and a control signal from an external source, a common voltage generator that generates the common voltage, and a voltage generator that compares the common voltage generated by the common voltage generator with the feedback common voltage fedback from the display panel to apply the gate-on voltage having a voltage level corresponding to the compared result to the gate driver.

The voltage generator can apply the gate-on voltage having a kickback slice to the gate driver when the common voltage applied to the display panel has substantially a same voltage level as the feedback common voltage fedback from the display panel.

The control circuit can include a timing controller that controls the data driver and the gate driver in response to an image signal and a control signal from an external source, a common voltage generator that generates the common voltage, and a voltage generator that generates the gate-on voltage and a gate-off voltage, which are applied to the gate driver. The timing controller compares the common voltage generated by the common voltage generator with the feedback common voltage fedback from the display panel to output a kickback signal based on the compared result, and the voltage generator generates the gate-on voltage having the voltage level corresponding to the kickback signal.

The timing controller outputs a kickback signal such that the voltage generator generates the gate-on voltage having a kickback slice when the common voltage generated by the common voltage generator has substantially the same voltage level as the feedback common voltage fedback from the display panel.

The control circuit can apply the gate-on voltage having no kickback slice to the gate driver when the common voltage applied to the display panel has a voltage level different from the feedback common voltage fedback from the display panel.

The kickback signal has a pulse width corresponding to a width of the kickback slice included in the gate-on voltage.

The voltage generator further generates a gate-off voltage applied to the gate driver.

According to at least one of the disclosed embodiments, the display apparatus generates the gate-on voltage having no kickback slice when a ripple is included in the feedback common voltage fedback from the display panel. This can prevent the display apparatus from malfunctioning due to a ripple in the feedback common voltage.

BRIEF DESCRIPTION OF THE DRAWINGS

The above and other advantages of the present disclosure will become readily apparent by reference to the following detailed description when considered in conjunction with the accompanying drawings.

DETAILED DESCRIPTION OF CERTAIN INVENTIVE EMBODIMENTS

Figure 1:
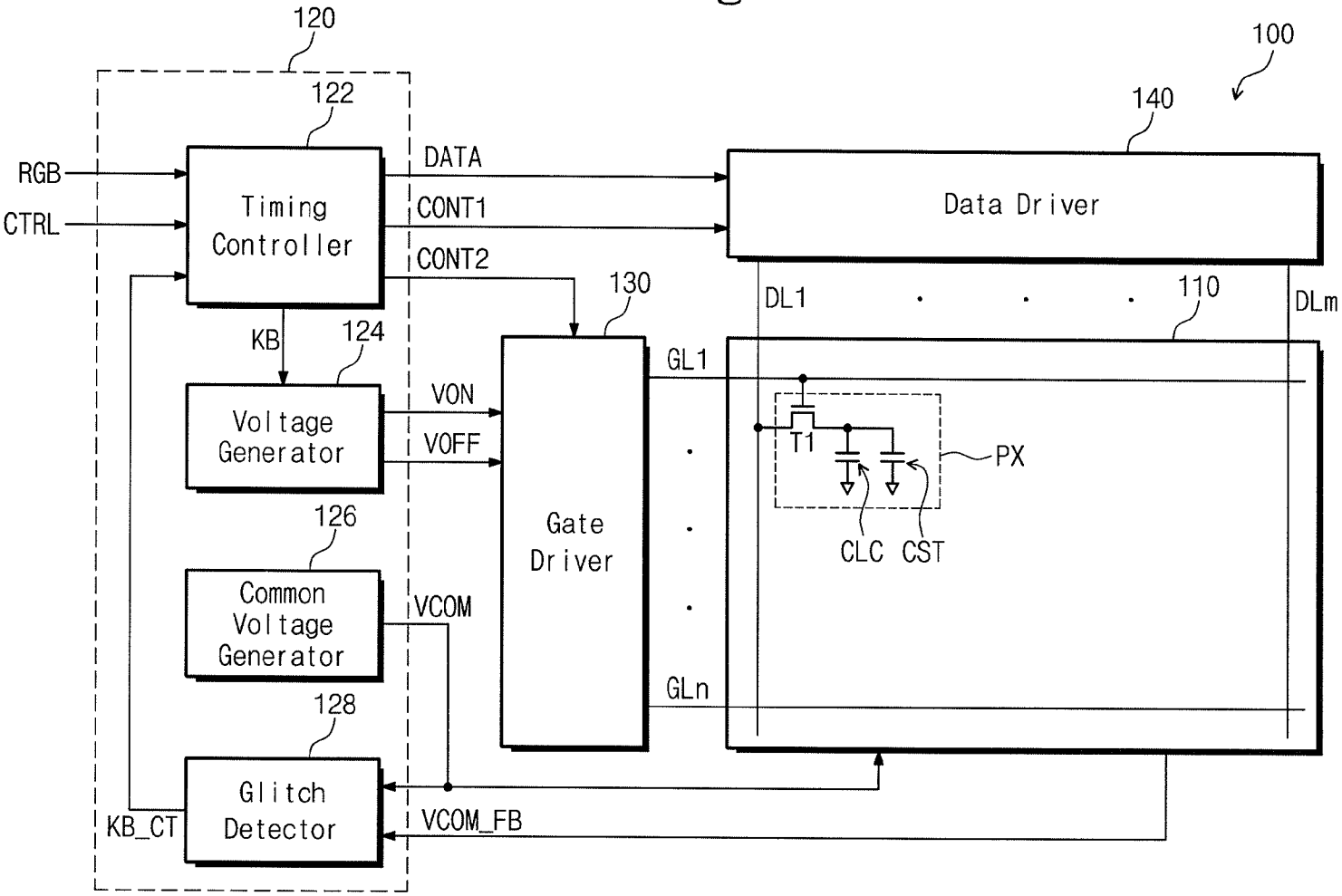
FIG. 1 is a block diagram showing a display apparatus according to an exemplary embodiment of the present disclosure.

It will be understood that when an element or layer is referred to as being "on", "connected to", or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present disclosure will be explained in detail with reference to the accompanying drawings.

FIG. 1 is a block diagram showing a display apparatus according to an exemplary embodiment of the present disclosure.

Referring to FIG. 1, a display apparatus 100 includes a display panel 110, a control circuit (or a controller) 120, a gate driver 130, and a data driver 140.

The display panel 110 includes a plurality of data lines DL1 to DLm, a plurality of gate lines GL1 to GLn crossing the data lines DL1 to DLm, and a plurality of pixels PX arranged in a matrix form in an area defined by the data lines DL1 to DLm crossing the gate lines GL1 to GLn. The data lines DL1 to DLm are insulated from the gate lines GL1 to GLn. Each of the pixels PX includes a switching transistor T1 connected to a corresponding data line of the data lines DL1 to DLm and a corresponding gate line of the gate lines GL1 to GLn, a liquid crystal capacitor CLC connected to the switching transistor T1, and a storage capacitor CST connected to the switching transistor T1.

The control circuit 120 includes a timing controller 122, a voltage generator 124, a common voltage generator 126, and a glitch detector 128. The timing controller 122 receives an image signal RGB and control signals CTRL, such as a vertical synchronization signal, a horizontal synchronization signal, a main clock signal, a data enable signal, etc., to control a display of the image signal RGB received from an external source. The timing controller 122 converts a data format of the image signal RGB to a data format appropriate to a driving condition of the display panel 110 based on the control signals CTRL to obtain a data signal DATA. The timing controller 122 applies the data signal DATA and a first control signal CONT1 to the data driver 140. The timing controller 122 applies a second control signal CONT2 to the gate driver 130. The first control signal CONT1 includes a horizontal synchronization start signal, a clock signal, and a line latch signal, and the second control signal CONT2 includes a vertical synchronization start signal, an output enable signal, and a gate pulse signal. The timing controller 122 applies a kickback signal KB to the voltage generator 124.

The voltage generator 124 generates a gate-on voltage VON and a gate-off voltage VOFF in response to the kickback signal KB received from the timing controller 122. The common voltage generator 126 generates a common voltage (or an initial common voltage) VCOM and applies the common voltage VCOM to the display panel 110. The common voltage VCOM is applied to one end of the liquid crystal capacitor CLC and one end of the storage capacitor CST of the pixel PX.

The glitch detector 128 receives the common voltage VCOM generated by the common voltage generator 126 and a feedback common voltage VCOM_FB fedback from the display panel 110 and applies a kickback control signal KB_CT to the timing controller 122. For instance, the glitch detector 128 outputs the kickback control signal KB_CT of a first level when the common voltage VCOM generated by the common voltage generator 126 has the same voltage level as that of the feedback common voltage VCOM_FB fedback from the display panel 110. The glitch detector 128 outputs the kickback control signal KB_CT of a second level when the common voltage VCOM has a voltage level different from that of the feedback common voltage VCOM_FB.

The gate driver 130 drives the gate lines GL1 to GLn in response to the second control signal CONT2 received from the timing controller 122 and the gate-on voltage VON and the gate-off voltage VOFF received from the voltage generator 124. The gate driver 130 includes a gate driver IC, but the gate driver 130 is not necessarily limited to the gate driver IC. That is, the gate driver 130 may be configured in a circuit using oxide semiconductor, amorphous semiconductor, crystalline semiconductor, or polycrystalline semiconductor.

The data driver 140 outputs gray-scale voltages to drive the data lines DL1 to DLm in response to the data signal DATA and the first control signal CONT1 received from the timing controller 122.

While a gate driving signal having substantially the same voltage level as that of the gate-on voltage VON is applied to one gate line of the gate lines GL1 to GLn, the switching transistor T1 connected to the one gate line is turned on and the gray-scale voltages are applied to the data lines DL1 to DLm from the data driver 140. A period in which the switching transistors arranged in one row are turned on, e.g., one period of the data enable signal DE, is called "one horizontal period" or "1H"

Figure 2:
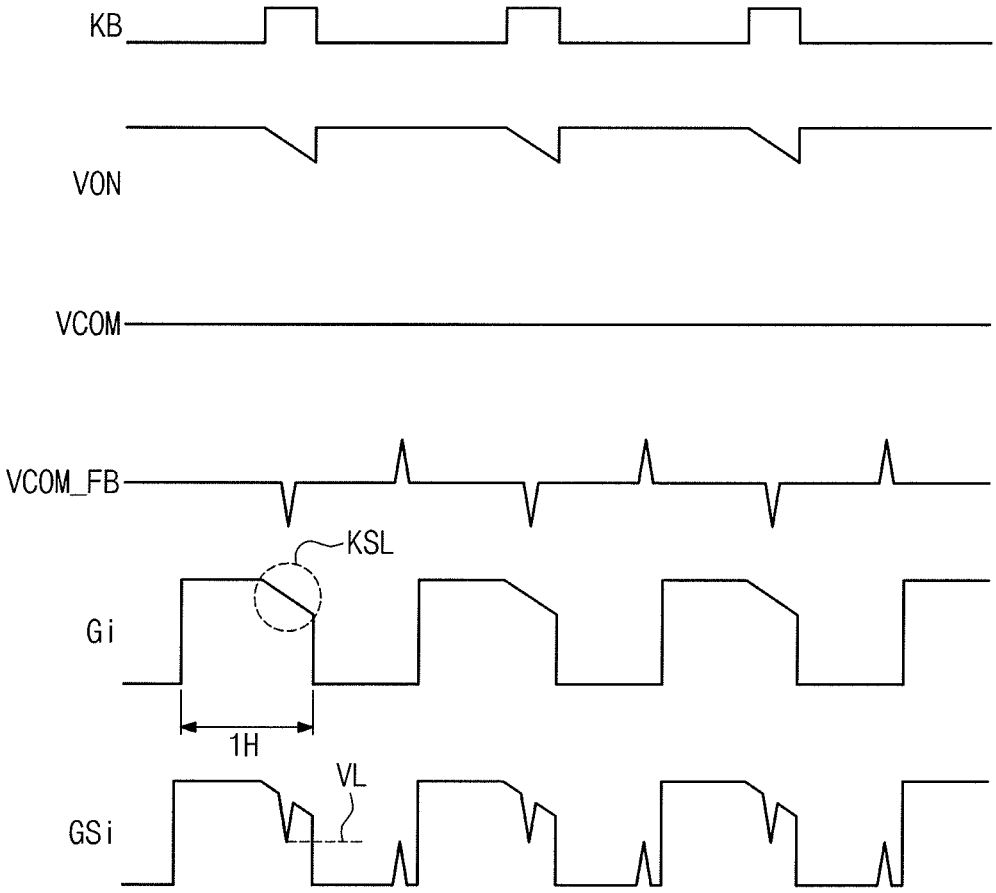
FIG. 2 is a timing diagram showing an example of a malfunction of a display panel when a glitch is included in a feedback common voltage fedback from the display panel shown in FIG. 1.

FIG. 2 is a timing diagram showing an example of a malfunction of the display panel when a glitch is included in the feedback common voltage fedback from the display panel shown in FIG. 1.

Referring to FIGS. 1 and 2, the voltage generator 124 generates the gate-on voltage VON in response to the kickback signal KB received from the timing controller 122. The gate-on voltage VON generated by the voltage generator 124 has a voltage level enough to turn on the switching transistor T1 of each pixel PX connected to the one gate line.

The voltage generator 124 lowers the voltage level of the gate-on voltage VON when the kickback signal KB is activated to a high level. A period during which the gate-on voltage VON is lowered while the kickback signal KB is at the high level is referred to as "a kickback slice". Thus, a gate driving voltage Gi, which is applied to a predetermined gate line GLi while the kickback signal KB is activated, includes the kickback slice KSL.

The common voltage generator 126 applies the common voltage VCOM at a predetermined level to the display panel 110. The glitch detector 128 receives the common voltage VCOM generated by the common voltage generator 126 and the feedback common voltage VCOM_FB fedback from the display panel 110 and outputs the kickback control signal KB_CT.

It is generally desirable to minimize the glitch in signals generated in the display apparatus 100. However, when the data signal DATA has a certain image pattern, the glitch may be generated in the common voltage VCOM applied to the one end of the liquid crystal capacitor CLC and the one end of the storage capacitor CST of the pixel PX.

When the glitch is generated in the common voltage VCOM applied to the one end of the liquid crystal capacitor CLC and the one end of the storage capacitor CST of the pixel PX, the same effect as that when a distorted gate driving signal GSi is applied to a gate terminal of the switching transistor T1 occurs. When the voltage level of the gate-on voltage VON of the distorted gate driving signal GSi, which is applied to the gate terminal of the switching transistor T1, is lower than a minimum reference voltage VL due to the glitch in the common voltage VCOM, the switching transistor T1 may be turned off Especially, when the kickback slice period of the gate driving signal Gi is overlapped with the glitch in the common voltage VCOM, the voltage level of the gate-on voltage VON of the distorted gate driving signal GSi may become lower than the minimum reference voltage VL.

As described above, when the switching transistor T1 is abnormally turned off, a time required to charge the liquid crystal capacitor CLC and the storage capacitor CST of the pixel PX is reduced, thereby causing a deterioration in a display quality of the image displayed on the display panel 110.

Figure 3:
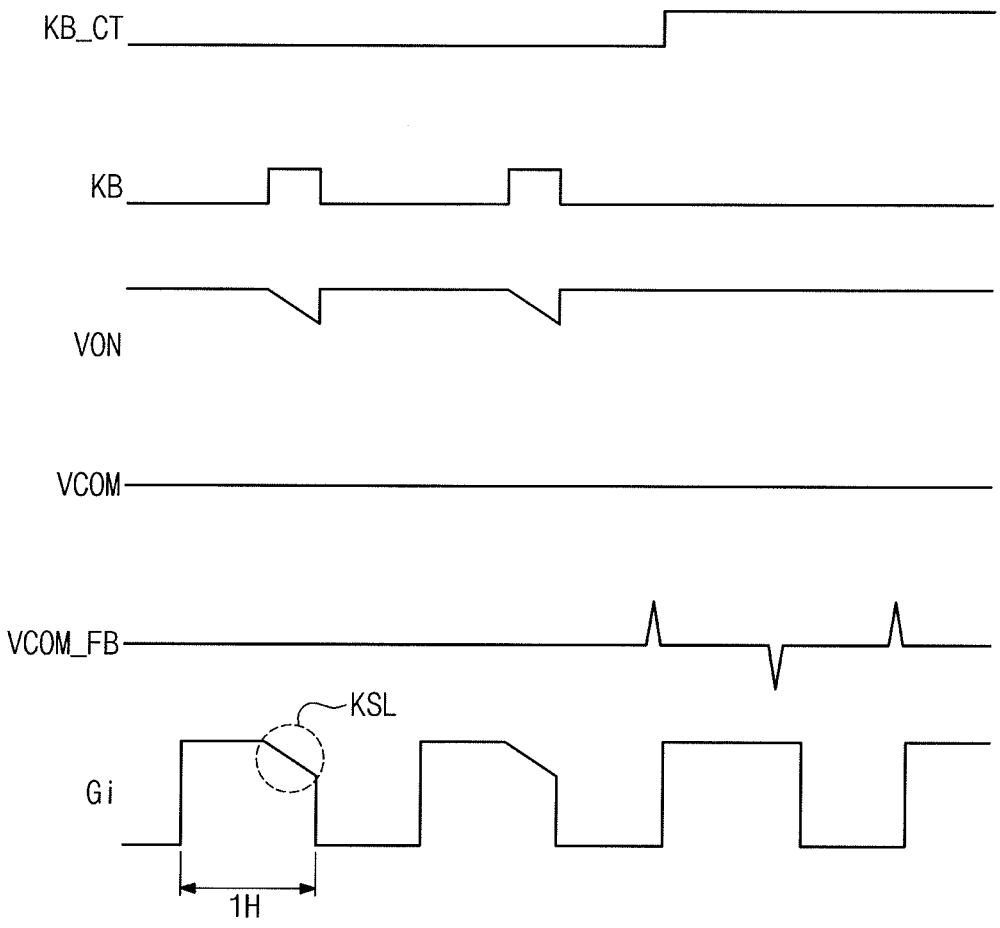
FIG. 3 is a timing diagram showing an example of changing a voltage level of a gate-on voltage when the glitch is included in the feedback common voltage fedback from the display panel shown in FIG. 1.

FIG. 3 is a timing diagram showing an example of changing a voltage level of the gate-on voltage when the glitch is included in the feedback common voltage fedback from the display panel shown in FIG. 1.

Referring to FIGS. 1 and 3, the glitch detector 128 compares the common voltage VCOM generated by the common voltage generator 126 with the feedback common voltage VCOM_FB fedback from the display panel 110 to output the kickback control signal KB_CT.

When the common voltage VCOM has substantially the same voltage level as that of the feedback common voltage VCOM_FB, the kickback control signal KB_CT is maintained at a first level, e.g., a low level. When the common voltage VCOM has a voltage level different from that of the feedback common voltage VCOM_FB, i.e., when the glitch is included in the feedback common voltage VCOM_FB, the kickback control signal KB_CT is transited to a second level, e.g., a high level, by the glitch detector 128.

The timing controller 122 generates the kickback signal KB in response to the kickback control signal KB_CT. For instance, the timing controller 122 outputs the kickback signal KB that is activated to the high level at every predetermined period when the kickback control signal KB_CT is at the first level and maintains the kickback signal KB at the low level when the kickback control signal KB_CT is transited to the second level.

The voltage generator 124 generates the gate-on voltage VON in response to the kickback signal KB. The voltage generator 124 lowers the voltage level of the gate-on voltage VON when the kickback signal KB is activated to the high level. Thus, the gate driving signal Gi applied to the predetermined gate line GLi includes the kickback slice KSL while the kickback signal KB is activated, and the gate driving signal Gi does not include the kickback slice KSL in a period during which the kickback signal KB is maintained at the low level.

When the glitch detector 128 determines that the glitch is not included in the feedback common voltage VCOM_FB, the kickback control signal KB_CT returns to the first level, e.g., the low level, again. In this case, the gate driving signal Gi output from the gate driver 130 includes the kickback slice KSL again.

When the data signal DATA has a specific image pattern that causes the glitch in the common voltage VCOM, the display apparatus 100 generates the gate-on voltage VON such that the gate driving signal Gi does not include the kickback slice KSL. Consequently, the display apparatus 100 may prevent a deterioration in the image quality of the image displayed on the display panel 110.

Figure 4:
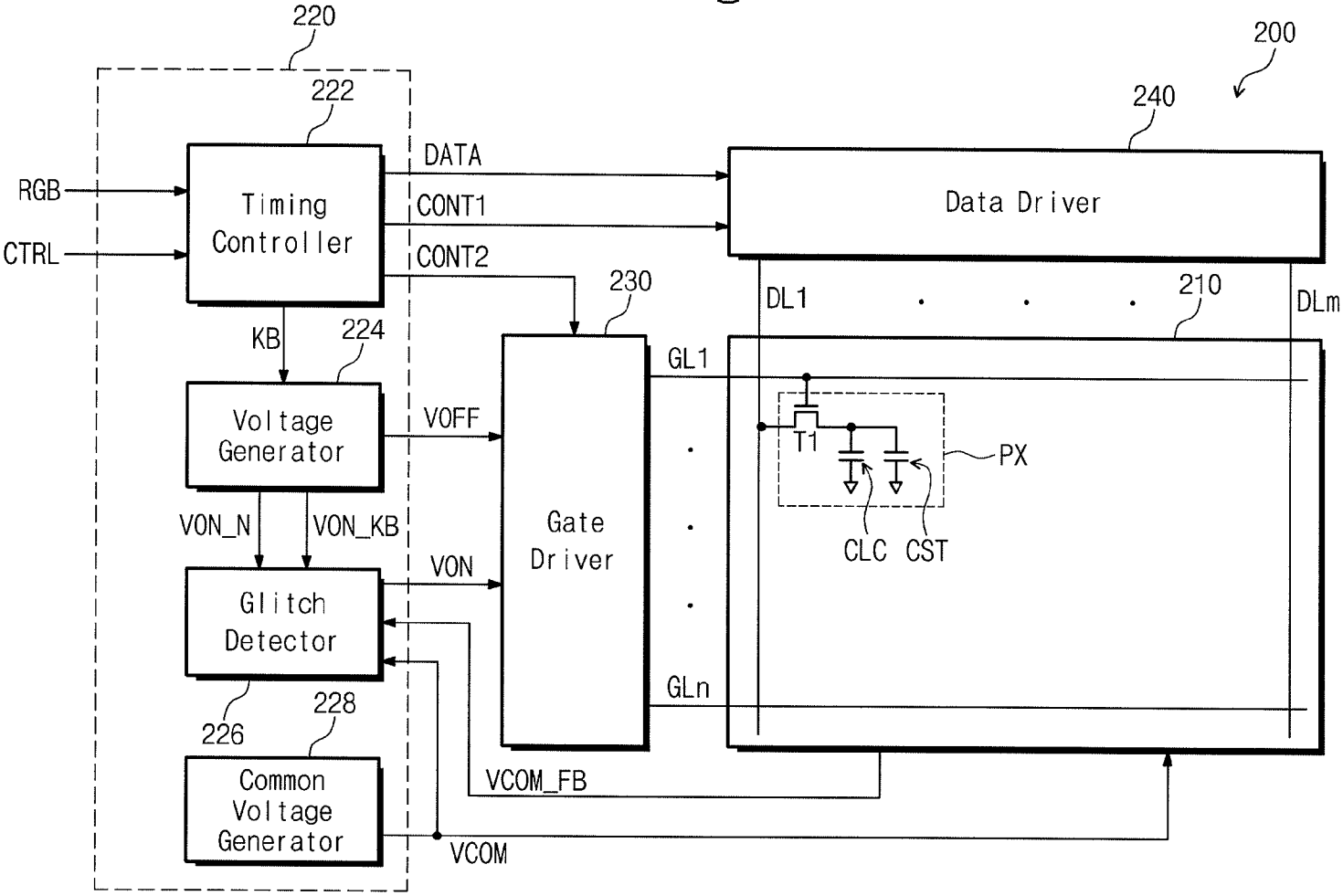
FIG. 4 is a block diagram showing a display apparatus according to another exemplary embodiment of the present disclosure.
Figure 5:
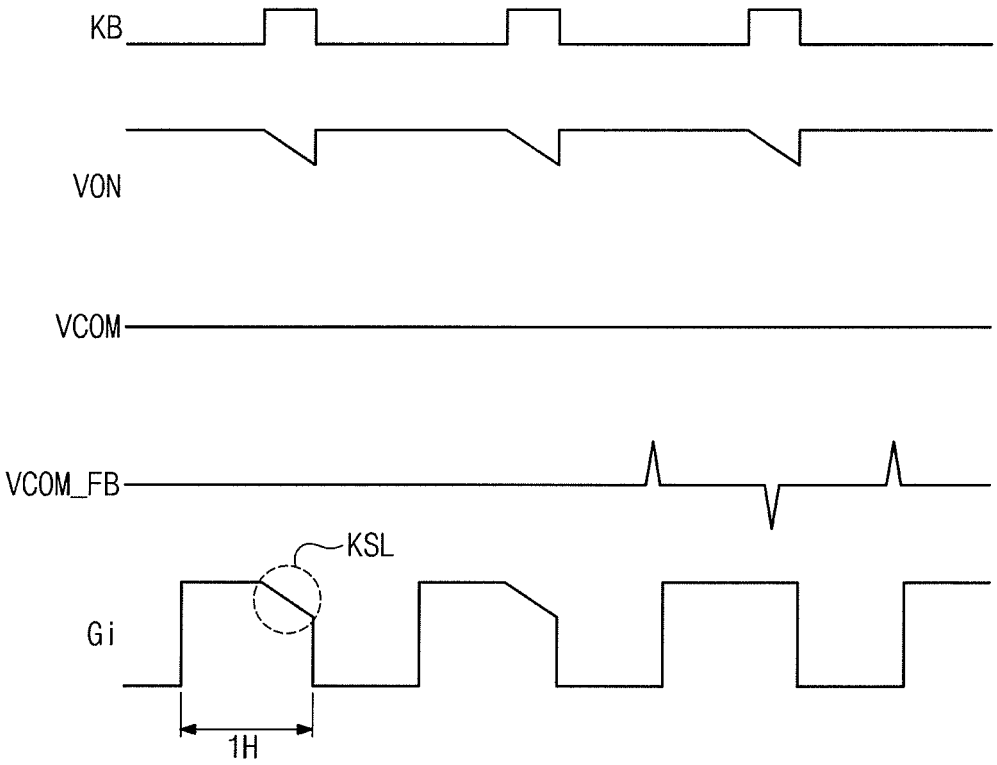
FIG. 5 is an exemplary timing diagram showing signals generated in a display apparatus shown in FIG. 4.

FIG. 4 is a block diagram showing a display apparatus according to another exemplary embodiment of the present disclosure, and FIG. 5 is a timing diagram showing signals generated in the display apparatus.

Referring to FIGS. 4 and 5, a display apparatus 200 includes a display panel 210, a control circuit 220, a gate driver 230, and a data driver 240.

In the present exemplary embodiment, since the display panel 210, the gate driver 230, and the data driver 240 have substantially the same structure and function as those of the display panel 110, the gate driver 130, and the data driver 140 shown in FIG. 1.

The control circuit 220 includes a timing controller 222, a voltage generator 224, a glitch detector 226, and a common voltage generator 228. The timing controller 222 receives an image signal RGB and control signals CTRL, such as a vertical synchronization signal, a horizontal synchronization signal, a main clock signal, a data enable signal, etc., to control a display of the image signal RGB received from an external source. The timing controller 222 converts a data format of the image signal RGB to a data format appropriate to a driving condition of the display panel 210 based on the control signals CTRL to obtain a data signal DATA and applies the data signal DATA and a first control signal CONT1 to the data driver 240. The timing controller 222 applies a second control signal CONT2 to the gate driver 230. The first control signal CONT1 includes a horizontal synchronization start signal, a clock signal, and a line latch signal, and the second control signal CONT2 includes a vertical synchronization start signal, an output enable signal, and a gate pulse signal. The timing controller 222 applies a kickback signal KB to the voltage generator 224.

The voltage generator 224 applies a first gate-on voltage VON_N and a second gate-on voltage VON_KB to the glitch detector 226 in response to the kickback signal KB from the timing controller 222 and applies a gate-off voltage VOFF to the gate driver 230. The first gate-on voltage VON_N has a voltage level enough to turn on a switching transistor T1 in a pixel PX. The second gate-on voltage VON_KB has substantially the same voltage level as that of the first gate-on voltage VON_N, but the voltage level of the second gate-on voltage VON_KB is gradually lowered during a period in which the kickback signal KB is activated.

The common voltage generator 228 generates a common voltage VCOM and applies the common voltage VCOM to the display panel 210. The common voltage VCOM is applied to one end of the liquid crystal capacitor CLC and the storage capacitor CST in the pixel PX.

The glitch detector 226 receives the first gate-on voltage VON_N and the second gate-on voltage VON_KB from the voltage generator 224, the common voltage VCOM from the common voltage generator 228, and a feedback common voltage VCOM_FB fedback from the display panel 210. The glitch detector 226 applies the gate-on voltage VON to the gate driver 230.

In detail, the glitch detector 226 outputs the second gate-on voltage VON_KB from the voltage generator 224 as the gate-on voltage VON when the common voltage VCOM generated by the common voltage generator 228 has the same voltage level as that of the feedback common voltage VCOM_FB fedback from the display panel 210. The glitch detector 226 outputs the first gate-on voltage VON_N as the gate-on voltage VON when the common voltage VCOM generated by the common voltage generator 228 has a voltage level different from that of the feedback common voltage VCOM_FB fedback from the display panel 210, that is, when the glitch is included in the feedback common voltage VCOM_FB.

In a case that the glitch is included in the feedback common voltage VCOM_FB due to various reasons, the display apparatus 200 drives the gate line GLi using the gate signal Gi, which has no kickback slice KSL, and thus the display quality of the image displayed on the display panel 210 may be prevented from being deteriorated.

Figure 6:
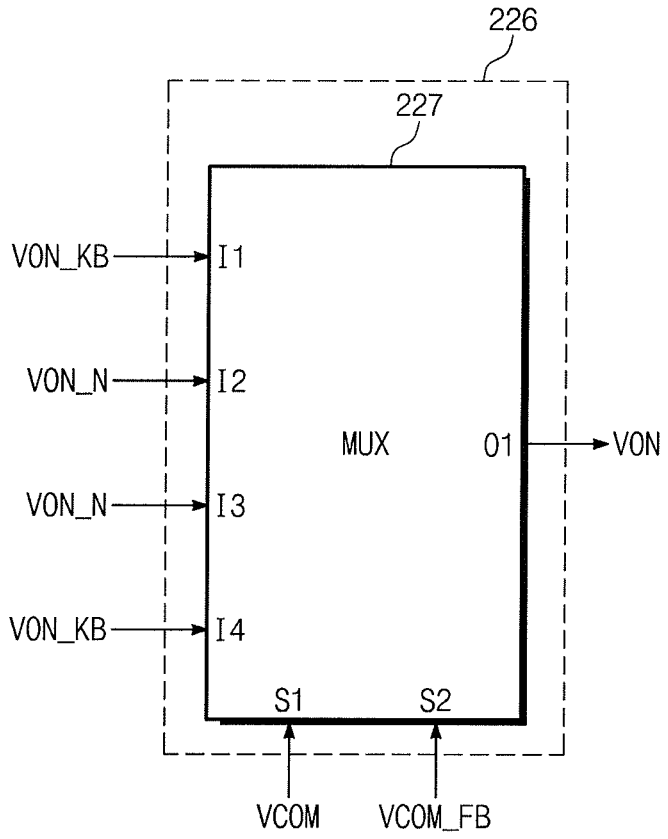
FIG. 6 is a view showing a configuration of an example of a glitch detector shown in FIG. 4.

FIG. 6 is a view showing an exemplary configuration of the glitch detector that can be used in FIG. 4.

Referring to FIGS. 4 and 6, the glitch detector 226 includes a multiplexer 227. The multiplexer 227 receives the common voltage VCOM from the common voltage generator 228 and the feedback common voltage VCOM_FB fedback from the display panel 210 through selection terminals S1 and S2. The multiplexer 227 receives the second gate-on voltage VON_KB, the first gate-on voltage VON_N, the first gate-on voltage VON_N, and the second gate-on voltage VON_KB respectively through a first input terminal I1, a second input terminal I2, a third input terminal I3, and a fourth input terminal I4. The multiplexer outputs the gate-on voltage VON through an output terminal O1.

The multiplexer 227 selects one of the first gate-on voltage VON_N and the second gate-on voltage VON_KB in response to the common voltage VCOM and the feedback common voltage VCOM_FB and outputs the selected first or second gate-on voltage as the gate-on voltage VON. For instance, when the common voltage VCOM and the feedback common voltage VCOM_FB have substantially the same voltage level, e.g., the first level or the second level, the multiplexer 227 outputs the second gate-on voltage VON_KB as the gate-on voltage VON. When the common voltage VCOM and the feedback common voltage VCOM_FB have different voltage levels from each other, the multiplexer 227 outputs the first gate-on voltage VON_N as the gate-on voltage VON.

Figure 7:
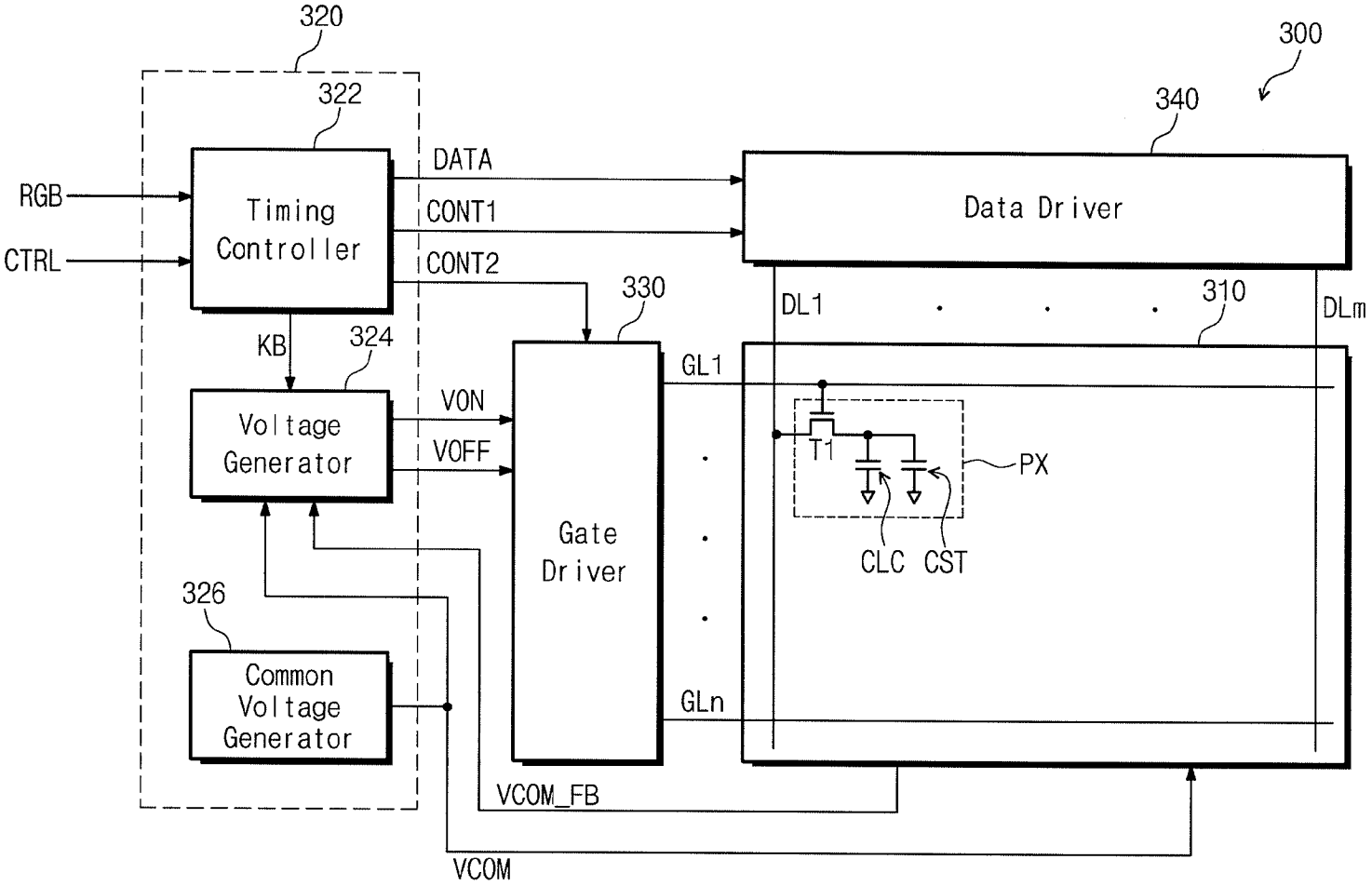
FIG. 7 is a block diagram showing a display apparatus according to another exemplary embodiment of the present disclosure.
Figure 8:
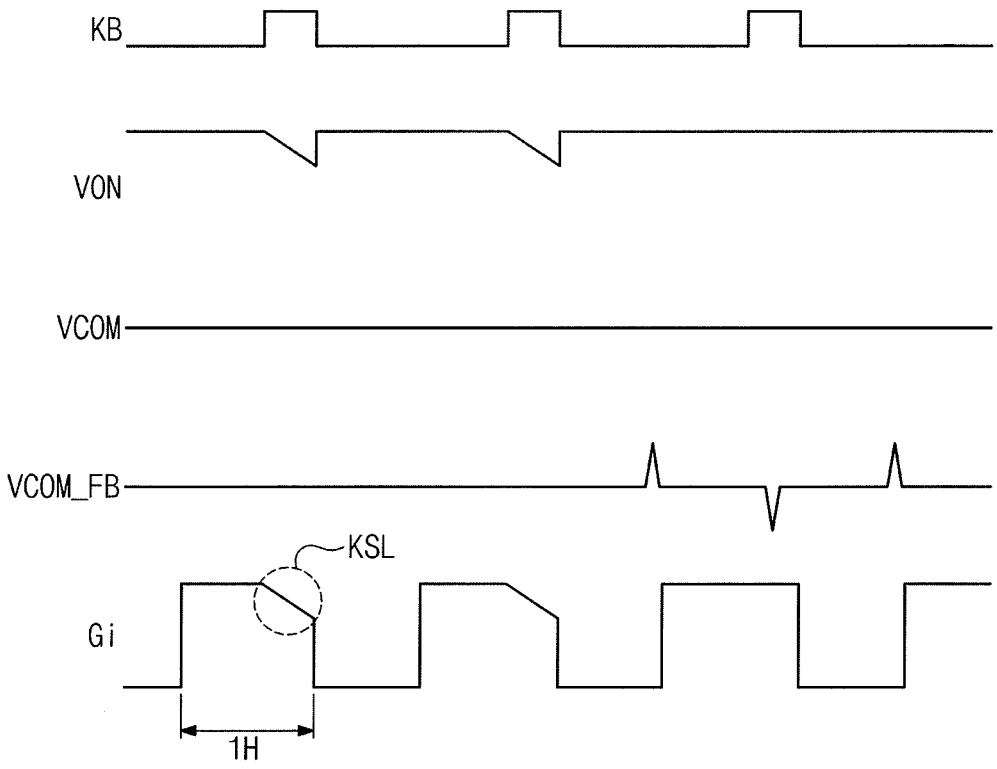
FIG. 8 is an exemplary timing diagram showing signals generated in a display apparatus shown in FIG. 7.

FIG. 7 is a block diagram showing a display apparatus according to another exemplary embodiment of the present disclosure. FIG. 8 is an exemplary timing diagram showing signals can be generated in a display apparatus of FIG. 7.

Referring to FIGS. 7 and 8, a display apparatus 300 includes a display panel 310, a control circuit 320, a gate driver 330, and a data driver 340.

In the present exemplary embodiment, since the display panel 310, the gate driver 330, and the data driver 340 have substantially the same function as those of the display panel 110, the gate driver 130, and the data driver 140 shown in FIG. 1.

The control circuit 320 includes a timing controller 322, a voltage generator 324, and a common voltage generator 326. The timing controller 322 receives an image signal RGB and control signals CTRL, such as a vertical synchronization signal, a horizontal synchronization signal, a main clock signal, a data enable signal, etc., to control a display of the image signal RGB from an external source. The timing controller 322 converts a data format of the image signal RGB to a data format appropriate to a driving condition of the display panel 310 based on the control signals CTRL to obtain a data signal DATA and applies the data signal DATA and a first control signal CONT1 to the data driver 340. The timing controller 322 applies a second control signal CONT2 to the gate driver 330. The first control signal CONT1 includes a horizontal synchronization start signal, a clock signal, and a line latch signal, and the second control signal CONT2 includes a vertical synchronization start signal, an output enable signal, and a gate pulse signal. The timing controller 322 applies a kickback signal KB to the voltage generator 324.

The voltage generator 324 generates a gate-on voltage VON and a gate-off voltage VOFF and applies the gate-on voltage VON and the gate-off voltage VOFF to the gate driver 330. The gate-on voltage VON has a voltage level enough to turn on a switching transistor T1 in a pixel PX.

The common voltage generator 326 generates a common voltage VCOM and applies the common voltage VCOM to the display panel 310. The common voltage VCOM is applied to one end of the liquid crystal capacitor CLC and one end of the storage capacitor CST in the pixel PX.

The voltage generator 324 generates the gate-on voltage VON in response to the kickback signal KB from the timing controller 322, the common voltage VCOM from the common voltage generator 326, and a feedback common voltage VCOM_FB fedback from the display panel 310.

In detail, the voltage generator 324 generates the gate-on voltage VON in response to the kickback voltage KB from the timing controller 322 when the common voltage VCOM generated by the common voltage generator 326 has substantially the same voltage level as that of the feedback common voltage VCOM_FB fedback from the display panel 310. However, the voltage generator 324 outputs the gate-on voltage VON maintained at a predetermined voltage level when the common voltage VCOM has a voltage level different from that of the feedback common voltage VCOM_FB fedback from the display panel 310, that is, when the glitch is included in the feedback common voltage VCOM_FB. Thus, in the case that the glitch is not included in the feedback common voltage VCOM_FB, the gate driving signal Gi output from the gate driver 330 includes the kickback slice KSL. Alternatively, in the case that the glitch is included in the feedback common voltage VCOM_FB, the gate driving signal Gi output from the gate driver 330 does not include the kickback slice KSL.

Figure 9:
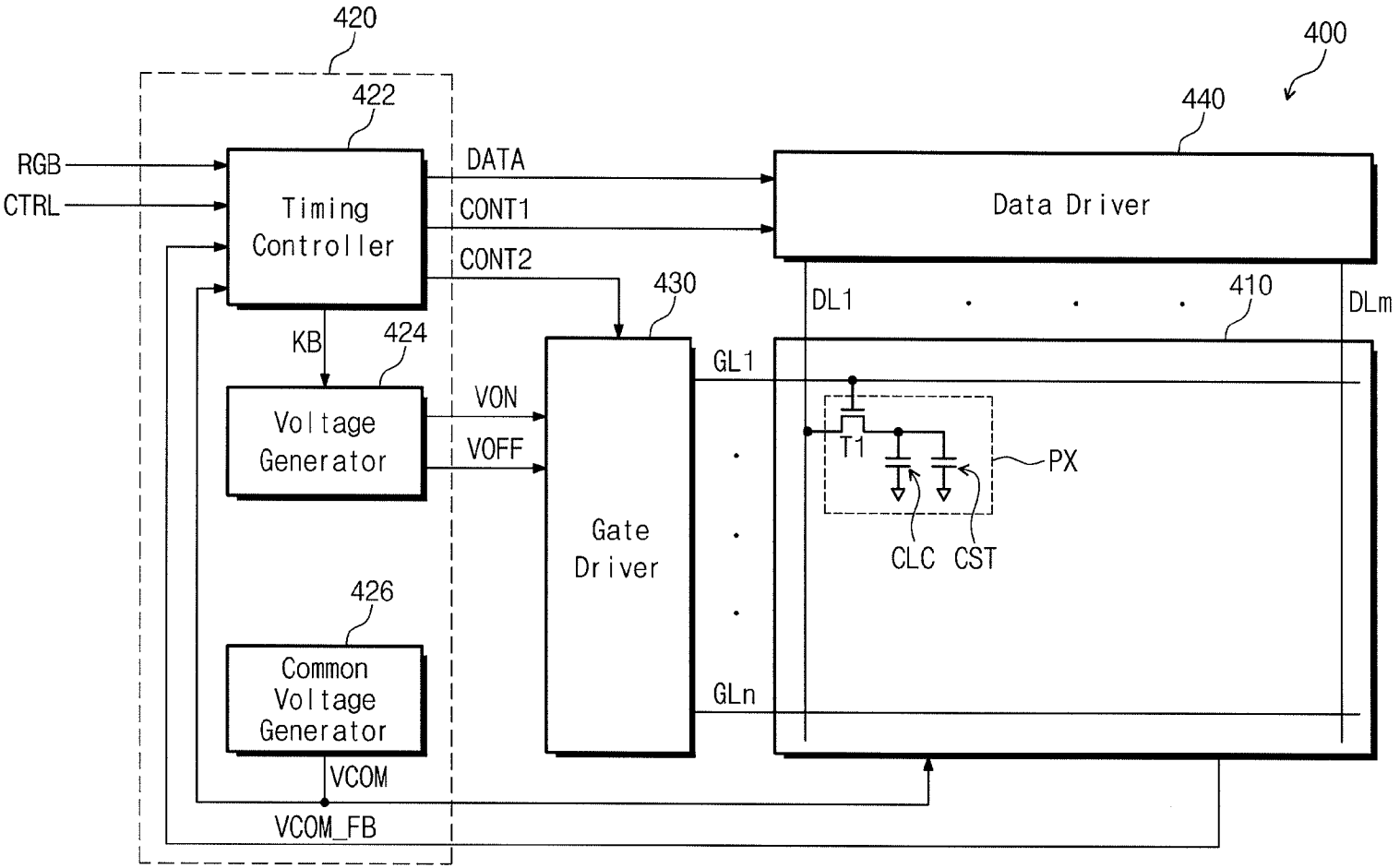
FIG. 9 is a block diagram showing a display apparatus according to another exemplary embodiment of the present disclosure.
Figure 10:
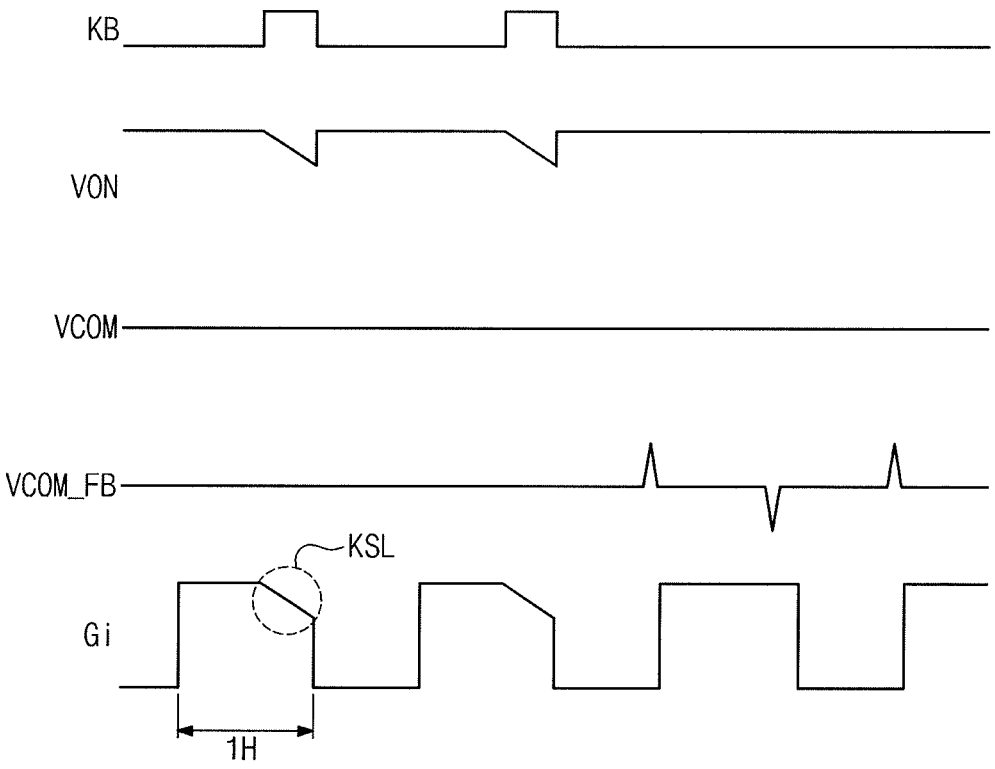
FIG. 10 is an exemplary timing diagram showing signals generated in a display apparatus of FIG. 9.

FIG. 9 is a block diagram showing a display apparatus according to another exemplary embodiment of the present disclosure. FIG. 10 is an exemplary timing diagram showing signals that can be generated in a display apparatus of FIG. 9.

Referring to FIGS. 9 and 10, a display apparatus 400 includes a display panel 410, a control circuit 420, a gate driver 430, and a data driver 440.

In the present exemplary embodiment, since the display panel 410, the gate driver 430, and the data driver 440 have substantially the same function as those of the display panel 110, the gate driver 130, and the data driver 140 shown in FIG. 1.

The control circuit 420 includes a timing controller 422, a voltage generator 424, and a common voltage generator 426. The timing controller 422 receives an image signal RGB and control signals CTRL, such as a vertical synchronization signal, a horizontal synchronization signal, a main clock signal, a data enable signal, etc., to control a display of the image signal RGB from an external source. The timing controller 422 converts a data format of the image signal RGB to a data format appropriate to a driving condition of the display panel 410 based on the control signals CTRL to obtain a data signal DATA and applies the data signal DATA and a first control signal CONT1 to the data driver 440. The timing controller 422 applies a second control signal CONT2 to the gate driver 430. The first control signal CONT1 includes a horizontal synchronization start signal, a clock signal, and a line latch signal, and the second control signal CONT2 includes a vertical synchronization start signal, an output enable signal, and a gate pulse signal. The timing controller 422 further generates a kickback signal KB.

The voltage generator 424 generates a gate-on voltage VON and a gate-off voltage VOFF and applies the gate-on voltage VON and the gate-off voltage VOFF to the gate driver 430. The gate-on voltage VON has a voltage level enough to turn on a switching transistor T1 in a pixel PX.

The common voltage generator 426 generates a common voltage VCOM and applies the common voltage VCOM to the display panel 410. The common voltage VCOM is applied to one end of the liquid crystal capacitor CLC and one end of the storage capacitor CST in the pixel PX.

The timing controller 422 outputs the kickback signal KB in response to the common voltage VCOM generated by the common voltage generator 426 and a feedback common voltage VCOM_FB fedback from the display panel 410.

In detail, the timing controller 422 outputs the kickback signal KB, which is activated to a high level at every predetermined period, when the common voltage VCOM generated by the common voltage generator 426 has substantially the same voltage level as that of the feedback common voltage VCOM_FB. The voltage generator 424 generates the gate-on voltage VON in response to the kickback signal KB. Thus, the gate driving signal Gi output from the gate driver 430 includes a kickback slice KSL.

On the other hand, the timing controller 422 outputs the kickback signal KB maintained at the low level when the common voltage generated by the common voltage generator 426 has the different voltage level from that of the feedback common voltage VCOM_FB fedback from the display panel 410, that is, when the glitch is included in the feedback common voltage VCOM_FB. The voltage generator 424 generates the gate-on voltage VON in response to the kickback signal KB. Thus, the gate driving signal Gi output from the gate driver 430 does not include the kickback slice KSL.

Although the above embodiments have been described with reference to the accompanying drawings, it is understood that the present disclosure should not be limited to these embodiments but various changes and modifications can be made by one ordinary skilled in the art within the spirit and scope of the present disclosure as hereinafter claimed.

What is claimed is:

1. A display apparatus comprising:

a display panel that includes a plurality of pixels electrically connected to a plurality gate lines and a plurality of data lines;

a gate driver configured to drive the gate lines;

a data driver configured to drive the data lines; and a controller configured to control the gate driver and the data driver to display an image on the display panel and apply an initial common voltage to the display panel, wherein the controller is configured to compare the initial common voltage and a feedback common voltage fedback from the display panel and apply a gate-on voltage, having a voltage level corresponding to the compared result, to the gate driver, wherein the gate-on voltage includes first and second wave forms different from each other and applied in different time periods based on whether or not the initial common voltage has substantially the same voltage level as the feedback common voltage, wherein the first wave form is configured to be applied when the initial common voltage is the same as the feedback common voltage, and wherein the second wave form is configured to be applied when the initial common voltage is different from the feedback common voltage.

2. The display apparatus of claim 1, wherein the controller is further configured to apply the gate-on voltage having a kickback slice to the gate driver when the initial common voltage has substantially the same voltage level as the feedback common voltage.

3. The display apparatus of claim 2, wherein the controller is configured to apply the gate-on voltage having no kickback slice to the gate driver when the initial common voltage has a voltage level different from the feedback common voltage.

4. The display apparatus of claim 1, wherein the controller comprises:

a timing controller configured to control the data driver and the gate driver in response to an image signal and a control signal received from an external source and output a kickback signal in response to a kickback control signal;

a voltage generator configured to output the gate-on voltage in response to the kickback signal;

a common voltage generator configured to generate the initial common voltage; and a glitch detector configured to compare the initial common voltage with the feedback common voltage to output the kickback control signal based at least in part on the compared result.

5. The display apparatus of claim 4, wherein the kickback signal has a pulse width corresponding to the width of the kickback slice included in the gate-on voltage.

6. The display apparatus of claim 1, wherein the controller comprises:

a timing controller configured to control the data driver and the gate driver in response to an image signal and a control signal received from an external source;

a common voltage generator configured to generate the initial common voltage;

a voltage generator configured to generate a first gate-on voltage and a second gate-on voltage; and a glitch detector configured to compare the initial common voltage with the feedback common voltage to apply the first gate-on voltage or the second gate-on voltage to the gate driver based at least in part on the compared result.

7. The display apparatus of claim 6, wherein the second gate-on voltage comprises a kickback slice.

8. The display apparatus of claim 7, wherein the glitch detector is further configured to apply the second gate-on voltage to the gate driver when the initial common voltage has substantially the same voltage level as the feedback common voltage.

9. The display apparatus of claim 7, wherein the glitch detector is further configured to apply the first gate-on voltage to the gate driver when the initial common voltage has a voltage level different from the feedback common voltage.

10. The display apparatus of claim 6, wherein the glitch detector comprises a multiplexer configured to output one of the first gate-on voltage and the second gate-on voltage in response to the initial common voltage and the feedback common voltage.

11. The display apparatus of claim 1, wherein the controller comprises:

a timing controller configured to control the data driver and the gate driver in response to an image signal and a control signal received from an external source;

a common voltage generator configured to generate the initial common voltage; and a voltage generator configured to compare the initial common voltage with the feedback common voltage to apply the gate-on voltage, having a voltage level corresponding to the compared result, to the gate driver.

12. The display apparatus of claim 11, wherein the voltage generator is further configured to apply the gate-on voltage having a kickback slice to the gate driver when the initial common voltage has substantially the same voltage level as the feedback common voltage.

13. The display apparatus of claim 1, wherein the controller comprises:

a timing controller configured to control the data driver and the gate driver in response to an image signal and a control signal received from an external source;

a common voltage generator configured to generate the initial common voltage; and a voltage generator configured to generate the gate-on voltage and a gate-off voltage, which are applied to the gate driver, wherein the timing controller is further configured to compare the initial common voltage with the feedback common voltage to output a kickback signal based at least in part on the compared result, and wherein the voltage generator is further configured to generate the gate-on voltage having the voltage level corresponding to the kickback signal.

14. The display apparatus of claim 13, wherein the timing controller is configured to output a kickback signal such that the voltage generator generates the gate-on voltage having a kickback slice when the initial common voltage has substantially the same voltage level as the feedback common voltage.

15. The display apparatus of claim 14, wherein the controller is configured to apply the gate-on voltage having no kickback slice to the gate driver when the initial common voltage has a voltage level different from the feedback common voltage.

16. The display apparatus of claim 15, wherein the kickback signal has a pulse width corresponding to the width of the kickback slice included in the gate-on voltage.

17. The display apparatus of claim 1, wherein the voltage generator is further configured to generate a gate-off voltage applied to the gate driver.

18. A display apparatus comprising:

a display panel configured to display an image;

a gate driver configured to drive a plurality of gate lines; and a controller configured to apply an initial common voltage to the display panel, wherein the controller is further configured to compare the initial common voltage and a feedback common voltage fedback from the display panel and apply a gate-on voltage, having a voltage level corresponding to the compared result, to the gate driver, wherein the gate-on voltage includes first and second wave forms different from each other and applied in different time periods based on whether or not the initial common voltage has substantially the same voltage level as the feedback common voltage, wherein the first wave form is configured to be applied when the initial common voltage is the same as the feedback common voltage, and wherein the second wave form is configured to be applied when the initial common voltage is different from the feedback common voltage.

19. The display apparatus of claim 18, wherein the controller is further configured to apply the gate-on voltage having a kickback slice to the gate driver when the initial common voltage has substantially the same voltage level as the feedback common voltage.

20. The display apparatus of claim 19, wherein the controller is further configured to apply the gate-on voltage having no kickback slice to the gate driver when the initial common voltage has a voltage level different from the feedback common voltage.

* * * * *